166-66 SR

11/8/83 XR 4,413,678

United States Patent [19]

Gillespie

[11] 4,413,678

[45] Nov. 8, 1983

[54] ALARM MEANS FOR USE WITH APPARATUS PROTECTING A DEVICE SITUATED IN A BOREHOLE

[75] Inventor: Ronald G. Gillespie, Old Tappan, N.J.

[73] Assignee: Texaco Development Corporation, White Plains, N.Y.

[21] Appl. No.: 229,699

[22] Filed: Jan. 29, 1981

[51] Int. Cl.[3] ..... E21B 33/12

[52] U.S. Cl. ..... 166/57; 166/66; 166/179

[58] Field of Search ..... 166/60, 66, 57, 179, 166/248, 113, 187, 607

[56] References Cited

U.S. PATENT DOCUMENTS

| | | | |
|---|---|---|---|
| 2,564,198 | 8/1951 | Elkins | 166/66 |
| 3,141,099 | 7/1964 | Brandon | 166/248 |
| 3,753,257 | 8/1973 | Arnold | 166/66 |
| 3,995,694 | 12/1976 | Freiburger | 166/187 |
| 4,140,179 | 2/1979 | Kasevich et al. | 166/60 |
| 4,185,691 | 1/1980 | Tubin | 166/66 |
| 4,236,113 | 11/1980 | Wiley | 166/187 |

*Primary Examiner*—William F. Pate, III

*Attorney, Agent, or Firm*—Carl G. Ries; Robert A. Kulason; Ronald G. Gillespie

[57] ABSTRACT

Apparatus situated in a borehole traversing an earth formation is protected from closing of the borehole by being encased in an inflatable device. Surface equipment inflates and maintains the inflatable device at a sufficient pressure so as to prevent the earth formation from closing in and contacting the apparatus. A pressure sensor senses the maintenance pressure and provides a corresponding signal. An alarm circuit provides an alarm when the pressure decreases below the sufficient maintenance pressure level.

7 Claims, 4 Drawing Figures

ALARM MEANS FOR USE WITH APPARATUS PROTECTING A DEVICE SITUATED IN A BOREHOLE

BACKGROUND OF THE INVENTION

FIELD OF THE INVENTION

The present invention relates to alarm systems in general and, more particularly, to an alarm system utilized with downhole apparatus.

SUMMARY OF THE INVENTION

Apparatus situated in a borehole traversing an earth formation is protected from closing of the borehole by an inflatable device. The device encompasses the apparatus and is inflated by a fluid to maintain a minimum open space by equipment located at the surface of the borehole. The pressure of the fluid is monitored and an alarm is provided when the sensed pressure decreases.

The objects and advantages of the invention will appear more fully hereinafter from a consideration of a detailed description which follows, taken together with the accompanying drawings wherein one embodiment of the invention is illustrated by way of example. It is to be expressly understood, however, that the drawings are for illustration purposes only and are not to be construed as defining the limits of the invention.

DESCRIPTION OF THE INVENTION

Large hydrocarbon reserves exist in the form of oil shale deposits if some economical means could be found to break it down into an extractable liquid and to produce it from wells in the deposit. Radio frequency heating of the deposits as shown in U.S. Pat. No. 4,196,329, issued Apr. 1, 1980, heats the oil shale deposit until pyrolysis occurs converting the kerogen in the oil shale deposit to shale oil and other hydrocarbons. However, as oil shale deposit heats up, the formation tends to close the borehole in which an RF antenna is suspended. The closing of the formation either damages the antenna or shorts out the antenna, shutting down the operation. The present invention alleviates this problem.

Figure 1:
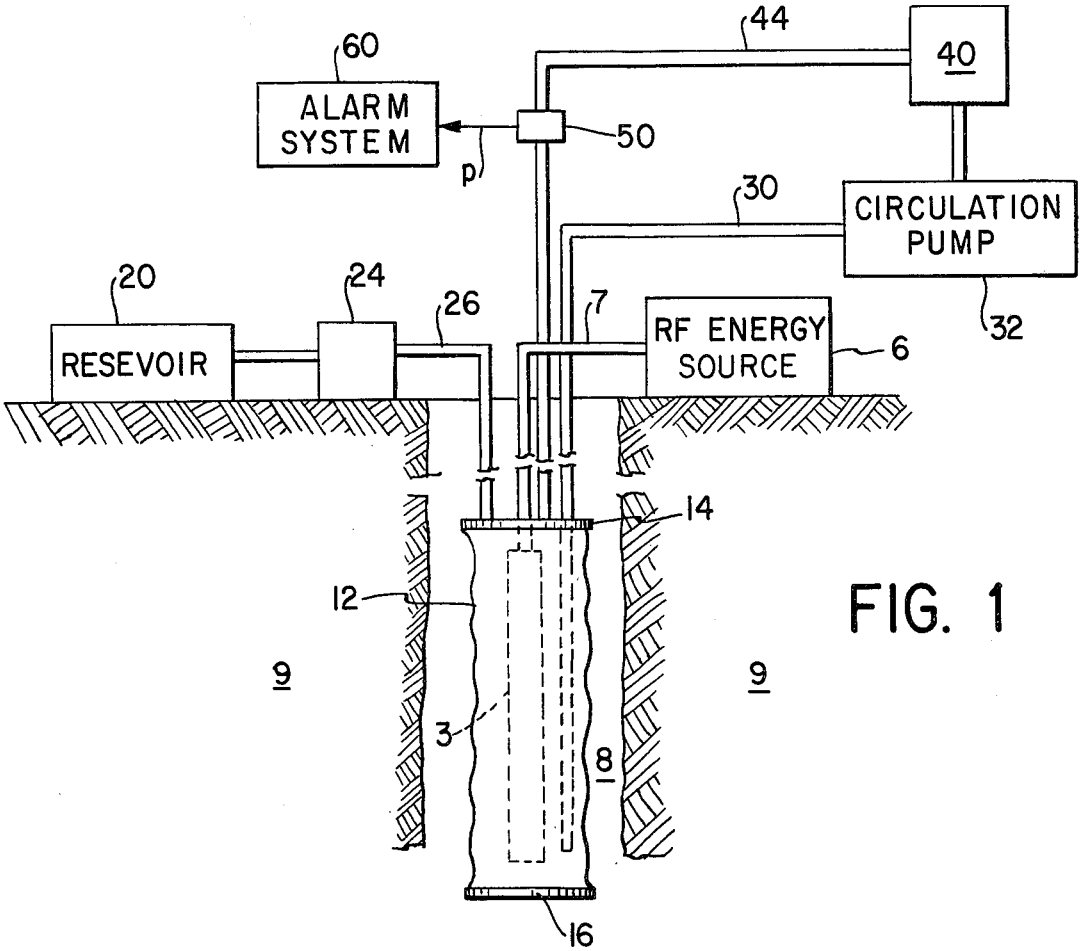
FIG. 1 shows a partial schematic form and partial block diagram form of a system constructed in accordance with the present invention for protecting apparatus in a borehole from closing of the borehole.

With reference to FIG. 1, an RF antenna 3 receives RF energy from a source 6 for radiation in a borehole 8 to an oil shale deposit 9. A sleeve 12 cooperates with end pieces 14 and 16 to protect antenna 3 as hereinafter explained. Sleeve 12 is made from flexible non-conductive material such as rubber. It should be noted that if the present invention is used to protect other downhole apparatus instead of an RF antenna, the non-conductive restriction may be dropped depending on the apparatus being protected. End piece 14 is especially adapted to pass the transmission piping as hereinafter explained. A reservoir 20 contains a fluid which may be a hydraulic liquid or gas which is pumped into a chamber 22, formed by sleeve 12 and end pieces 14 16, by a hydraulic pump 24 through a line 26. The hydraulic fluid in sleeve 12 causes it to expand to form at least the same diameter as that of the end pieces 14 and 16. As the formation continues to press in, the pressure of the hydraulic fluid is increased so as to maintain sufficient clearance for antenna 3.

As the hydraulic fluid in sleeve 12 heats up, it is cooled by circulation through a line 30 to a circulation pump 32 which provides it to a heat exchanger 40 for cooling and returns to sleeve 12 by way of a line 44 so as to keep the hydraulic fluid from overheating.

The foregoing is an excerpt from copending U.S. application Ser. No. 229,697, filed Jan. 29, 1981.

When inflatable sleeve 12 is required to be inflated for a long period of time, hydraulic leaks can develop or there can be a catastrophic type failure which, when known about immediately, can result in an operator shutting off the RF radiation and, if necessary, pulling RF antenna 3 before the earth formation closes in on it. An alarm system of the present invention warns of such a leak or of the catastrophic failure.

Referring again to FIG. 1, a pressure sensor 50 is located in a fluid circulation system, such as line 44, or if the fluid is not circulated, then in line 26 from pump 24 to end piece 14, which provides a signal P representative of the pressure of the fluid in chamber 22. Sensor 50 provides signal P to an alarm system 60.

Figure 3:
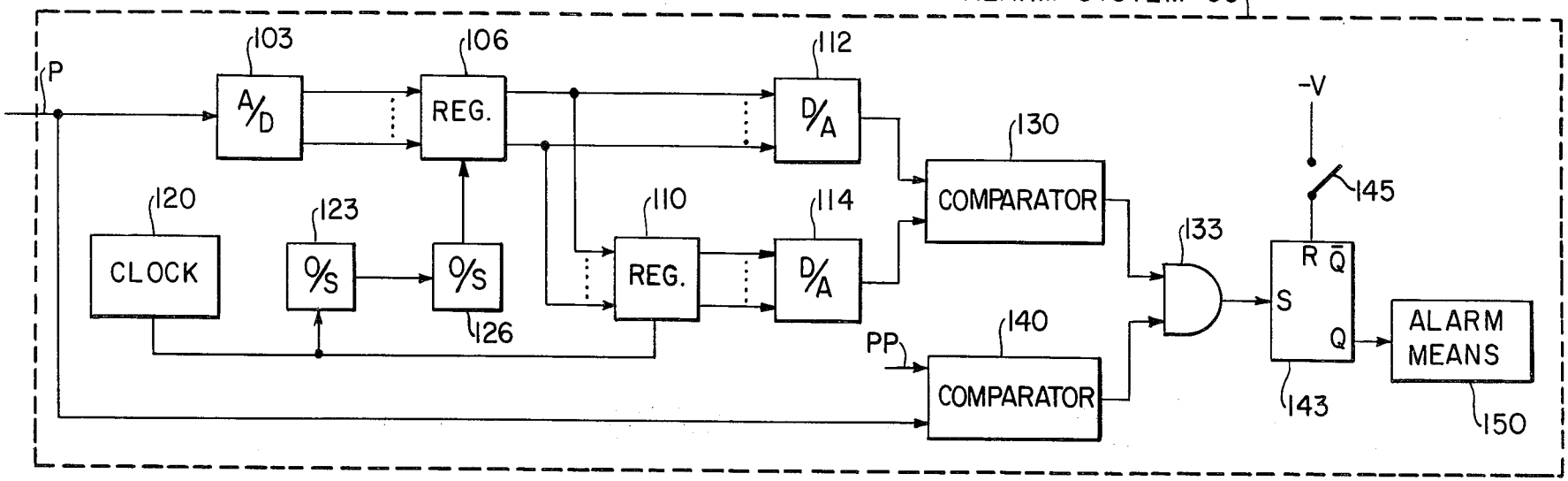
FIG. 3 is a detailed block diagram of the alarm system shown in FIG. 1.
Figure 4:
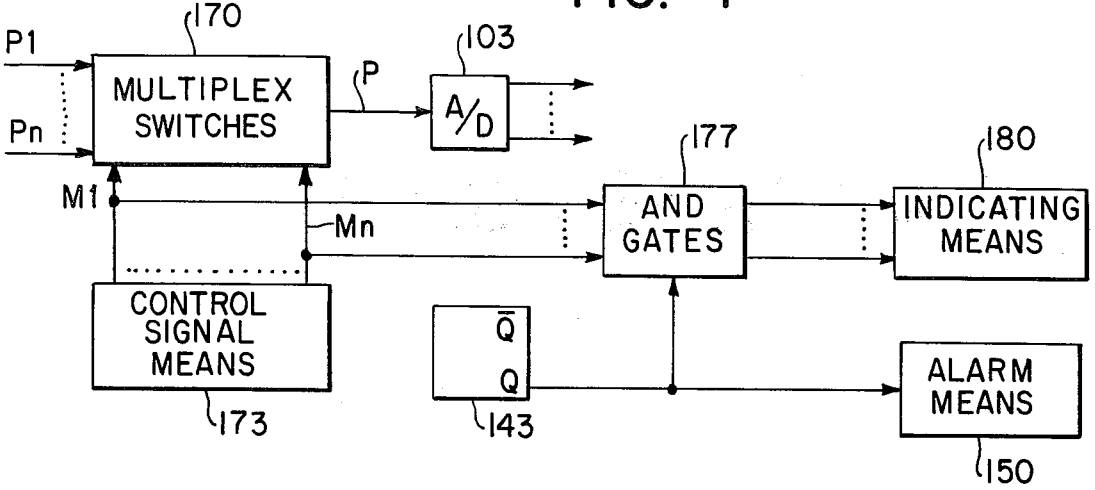
FIG. 4 is a detailed block diagram of modification to the alarm system of FIG. 2 for use with a plurality of apparatus in a plurality of boreholes.

Referring now to FIG. 3, signal P is provided to an analog-to-digital converter 103 in alarm system 60 which provides corresponding digital signals to a register 106. Register 106 provides digital signals to a second register 110 and to a digital-to-analog converter 112. Register 110 provides digital signals to another digital-to-analog converter 114. A clock 120 periodically provides clock pulses to register 110 causing it to enter the data contained in register 106. Each clock pulse also triggers a delay one-shot multivibrator 123 which provides a corresponding pulse to another one-shot multivibrator 126. One-shot 126 provides an 'enter' pulse to register 106.

In operation, therefore, as pressure is building up in the system, the corresponding digital signals are applied to register 106. In the initial cycle of operation, register 110 is activated first to enter the contents of 106 which at this time is zero. Then, due to the delay action of one-shot 123, after the clock pulse to register 110 has terminated, and 'enter' pulse from one-shot 126 causes register 106 to enter the digital signals from analog-to-digital converter 103. In the second cycle of operation, register 110 is activated to enter the signals corresponding to the contents of register 106 for the first cycle and immediately after the entry, register 106 enters the new signals from analog-to-digital converter 103 so that in time sequence, register 110 always has the hydraulic pressure value for the next preceding cycle while register 106 has the hydraulic pressure value for the current cycle. The outputs of digital-to-analog converters 112 and 114 are compared by a comparator 130 which provides a signal to an AND gate 133. As long as the hydraulic pressure is building or remains the same, comparator 130 provides a high logic level signal to an AND gate 133. When the pressure decreases, as is the case when a leak occurs, comparator 130 provides a low logic signal to AND gate 133, thereby disabling it.

Signal P is also applied to a comparator 140 receiving a signal RP corresponding to an upper limit for the pressure in the sleeve to cover the situation that the pressure may go beyond that of a safe value. The output of comparator 140 is also connected to AND gate 133 and normally, the output signal is at a high logic level until signal P exceeds the value of the reference signal RP. The output of AND gate 133 is connected to the set input of a flip-flop 143. Flip-flop 143 has an R input connected to the switch 145 receiving a negative direct current voltage −V. Switch 145 is of the momentary single pole, single throw type which is operator activated to reset flip-flop 143. The Q output of flip-flop 143 is connected to alarm means 150 which provides either an audio alarm or a visual alarm or both when the Q output of flip-flop 143 provides a high logic level signal. Flip-flop 143 will provide a high logic level signal at its Q output when in the set state and a low logic level signal when in its clear state.

Normally, the signals from comparators 130, 140 are at high logic levels so that AND gate 133 provides a high logic level signal to the set input of flip-flop 143. Upon a decrease in pressure, which is usually associated with a leak or with catastrophic failure of the sleeve, the signal from comparator 130 goes to a low logic level. In response, the signal provided by AND gate 133 goes to a low logic level triggering flip-flop 143 to the set state, causing the alarm to sound. Similarly, if the pressure in the sleeve exceeds that of the reference value, comparator 140 provides its signal at a low logic level which, in turn, also causes AND gate 133 to go to a low logic level with the same results as hereinbefore mentioned.

Figure 2:
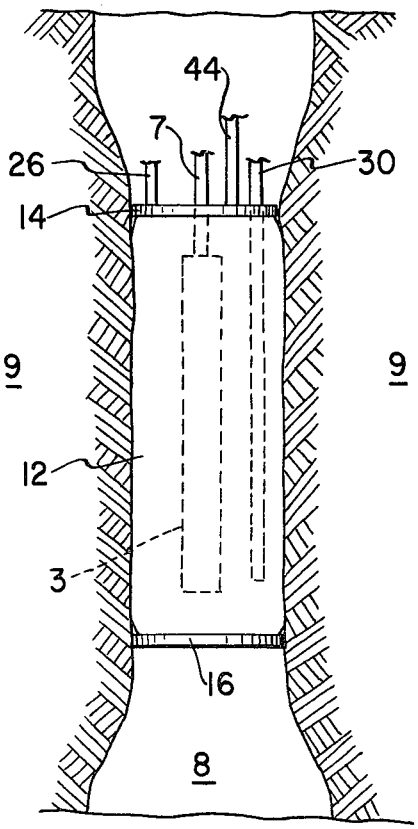
FIG. 2 is a schematic diagram showing the sleeve shown in FIG. 1 in an inflated condition.

The alarm system is also applicable to multiple hole efforts. The alarm system of the present invention is readily adapted for such operation by providing multiplexing switches 170 as shown in FIG. 3 which receives signals P1 through Pn corresponding to the signal P in FIG. 2, for protective devices in the different boreholes. Multiplex switches 170 are controlled by control signals M1 through Mn provided by control signal means 173 to sequentially pass signals P1 through Pn as signal P to the analog-to-digital converter 103 for further processing as mentioned for FIG. 2. Control signals M1 through Mn are provided to a plurality of two-input AND gates 177. One input of each AND gate in AND gates 177 is connected to the Q output of flip-flop 143. Since the signals M1 through Mn render a switch conductive in multiplex switches 170 when at a high logic level, upon the occurrence of an alarm the Q output from flip-flop 143 is at a high logic level, thereby causing one AND gate in the plurality of AND gates 177 to be enabled to provide its high logic level output to an indicating means 180 which, by way of example, may be a battery of lights. Further, signal P is also applied to comparator 140 which functions as hereinbefore explained. Each light is connected to a corresponding AND gate and identified with a corresponding RF antenna sleeve 12 and end pieces 14 and 16 being monitored. Thus, with the occurrence of an alarm, the indicating means will indicate which unit has experienced a failure or is exceeding the pressure limit.

The present invention is an alarm system for use with a downhole protective device. Further, through multiplexing, it can be adapted to multiple borehole use.

What is claimed is:

1. An improvement to an apparatus for the in-situ recovery of hydrocarbons from an oil shale deposit wherein an RF antenna is entered into a borehole traversing the oil shale desposit and is energized so as to heat the oil shale deposit, comprising inflatable, non-conductive means encompassing said RF antenna for protecting the antenna, means for inflating said inflatable means with a fluid so as to prevent portions of the heated oil shale deposit from contacting said RF antenna, means for sensing the pressure of the fluid and providing a corresponding pressure signal, and means for providing an alarm in accordance with the pressure signal when the pressure of the fluid has decreased; said alarm means includes sample and hold means which periodically sample and hold the pressure signal, means connected to the sample and hold means for comparing the current cycle pressure with the previous cycle pressure and providing a comparison signal in accordance therewith, and means connected to the comparison means for providing an alarm when the pressure of the current cycle is less than the pressure of the next previous cycle.

2. An improvement as described in claim 1 in which the inflating means includes a reservoir of hydraulic fluid, and pump means connected to said reservoir and to said inflatable means for pumping the hydraulic fluid to the inflatable means so as to inflate it.

3. An improvement as described in claim 2, further comprising second comparing means receiving a reference signal corresponding to a predetermined pressure level and receiving the pressure signal for providing a signal corresponding to the comparison of the pressure signal to the reference signal, and an alarm means provides an alarm in accordance with the comparison signals.

4. An alarm system monitoring a plurality of protective devices, each protective device protecting an RF antenna in a borehole traversing an oil shale deposit, said RF antenna being energized so as to heat the oil shale deposit, and each protective device includes inflatable means encompassing a corresponding RF antenna which is inflated by hydraulic fluid at a sufficient pressure so as to maintain inflation, thereby preventing closure of the borehole, said alarm system comprising a plurality of pressure sensors, each pressure sensor sensing hydraulic fluid pressure for a corresponding inflatable means and providing a pressure signal representative thereof, multiplexing means connected to the pressure sensors for multiplexing the pressure signals to provide a multiplexed pressure signal and for providing control signals, alarm means connected to the multiplexing means for providing an alarm when the multiplexed pressure signal communicates that the hydraulic fluid pressure in at least one inflatable device is decreasing, and indicating means connected to the multiplexing means and to the alarm means for indicating in which inflatable means the hydraulic fluid pressure is decreasing in accordance with the alarm signal and the multiplexing of the pressure signals.

5. An alarm system as described in claim 4 in which the alarm means includes sample and hold means connected to the multiplexing means which periodically sample and hold the multiplexed pressure signal, means connected to the sample and hold means for comparing the current cycle pressure with the previous cycle pressure and providing a comparison signal in accordance therewith, and network means connected to the comparison means for providing an alarm and the alarm signal when the pressure in an inflatable means during the current cycle is less than the pressure in the inflatable means for the next previous cycle.

6. An alarm system as described in claim 5 in which the multiplexing means includes multiplexing switches receiving the pressure signals from the plurality of pressure sensors, and control signal means connected to the multiplexing switches and to the indicating means for providing control signals to the indicating means and to the multiplexing switches in such a manner as to control the multiplexing switching switches to sequentially pass the pressure signals to provide a multiplexed pressure signal and to identify which pressure signal is representative of decreasing pressure.

7. An alarm system as described in claim 6 in which the indicating means includes a plurality of AND gates connected to the control signal means and to the alarm means, each AND gate receiving a different control signal and being partially enabled by its control signal when a corresponding multiplexing switch is rendered conductive and fully enabled to provide a high logic level signal when the alarm means provides the alarm signal, and a plurality of light means, each light means being connected to a different AND gate for being responsive to a high logic level signal from the AND gate to provide light.

* * * * *